US007028342B1

(12) United States Patent
Nordstrom et al.

(10) Patent No.: US 7,028,342 B1
(45) Date of Patent: Apr. 18, 2006

(54) GARMENT HAVING MULTIPLE LAYERS

(75) Inventors: Matthew D. Nordstrom, Portland, OR (US); Richard C. MacDonald, Portland, OR (US); Jordan J. Wand, Portland, OR (US)

(73) Assignee: Nike, Inc., Beaverton, OR (US)

( * ) Notice: Subject to any disclaimer, the term of this patent is extended or adjusted under 35 U.S.C. 154(b) by 125 days.

(21) Appl. No.: 10/397,904

(22) Filed: Mar. 26, 2003

(51) Int. Cl.
*A41D 1/00* (2006.01)

(52) U.S. Cl. ..... 2/119; 2/69

(58) Field of Classification Search ..... 2/125, 2/119, 101, 108, 69; 24/303, 66.1
See application file for complete search history.

(56) References Cited

U.S. PATENT DOCUMENTS

| | | | | | |
|---|---|---|---|---|---|
| 1,157,341 | A | | 10/1915 | Tallerday | |
| 1,250,836 | A | | 12/1917 | Fowler | |
| 1,285,917 | A | | 11/1918 | Bradley | |
| 2,301,527 | A | | 11/1942 | English et al. | 2/97 |
| 2,389,298 | A | | 11/1945 | Ellis | 2/96 |
| 2,389,299 | A | | 11/1945 | Ellis | 2/96 |
| 2,441,122 | A | | 5/1948 | Sturz | 2/97 |
| 2,582,772 | A | | 1/1952 | Egbert | 2/97 |
| 3,160,892 | A | | 12/1964 | Semons | 2/88 |
| 3,919,743 | A | | 11/1975 | Cutler | 24/201 |
| 4,121,324 | A | | 10/1978 | Marbacher | 24/73 |
| 4,249,267 | A | | 2/1981 | Voss | 2/69 |
| 4,453,294 | A | | 6/1984 | Morita | 24/303 |
| 4,470,155 | A | | 9/1984 | Maeshima | 2/108 |
| 4,554,682 | A | * | 11/1985 | Hillquist | 2/70 |
| 4,559,647 | A | | 12/1985 | Smith | 2/158 |
| 4,570,267 | A | | 2/1986 | Appel | 2/91 |
| 4,706,304 | A | | 11/1987 | Jones | 2/91 |
| 4,941,236 | A | | 7/1990 | Sherman et al. | 24/303 |
| 5,088,116 | A | | 2/1992 | Gould | 2/82 |
| 5,103,501 | A | * | 4/1992 | Meisels | 2/113 |
| 5,109,547 | A | | 5/1992 | Abdallah | 2/145 |
| 5,307,582 | A | | 5/1994 | Quintel | 40/633 |
| 5,361,523 | A | | 11/1994 | Robinson | 40/586 |
| D368,353 | S | | 4/1996 | McCrudden | D2/841 |
| 5,604,960 | A | * | 2/1997 | Good | 24/303 |
| 5,715,538 | A | | 2/1998 | Soll | 2/145 |
| 5,718,000 | A | | 2/1998 | Ost et al. | 2/69 |
| 5,836,018 | A | | 11/1998 | Lee | 2/144 |
| 5,873,131 | A | | 2/1999 | Sabin | 2/69 |

(Continued)

OTHER PUBLICATIONS

"Brenda's Collared Shrug"; http://www.needlebeetle.com/free/shrg.htm; print Nov. 14, 2001.

*Primary Examiner*—John J. Calvert
*Assistant Examiner*—Andrew W. Sutton
(74) *Attorney, Agent, or Firm*—Banner & Witcoff, Ltd.

(57) ABSTRACT

A garment system includes a torso covering member and an upper back and shoulder covering member secured to the torso covering member by a fastener. The garment may include a plurality of torso covering members, each having a configuration different from each of the others, and a plurality of upper back and shoulder covering members, each having a configuration different from each of the others. In certain embodiments, the fastener has a first portion secured to the torso covering member and a second portion secured to the upper back and shoulder covering member. The fastener may be a magnetic fastener, and at least one of the first portion and the second portion of the fastener may have a surface discontinuity configured to mate with the other of the first portion and second portion.

43 Claims, 4 Drawing Sheets

U.S. PATENT DOCUMENTS

| | | | | |
|---|---|---|---|---|
| 6,047,413 | A | 4/2000 | Welchel et al. | 2/457 |
| 6,052,828 | A | 4/2000 | Widdemer | 2/161.2 |
| D431,343 | S | 10/2000 | Sampson | D2/610 |
| 6,163,938 | A * | 12/2000 | Weber-Unger | 24/303 |
| D442,765 | S | 5/2001 | Newman | D2/610 |
| 6,226,842 | B1 | 5/2001 | Wong | 24/303 |
| 6,292,985 | B1 | 9/2001 | Grunberger | 24/303 |
| 6,298,485 | B1 | 10/2001 | Heller | 2/70 |
| 6,752,075 | B1 * | 6/2004 | Ciaramitaro et al. | 101/33 |
| 6,779,199 | B1 * | 8/2004 | O'Dea et al. | 2/161.6 |

* cited by examiner

GARMENT HAVING MULTIPLE LAYERS

FIELD OF THE INVENTION

The present invention is directed to a garment, and, more particularly, to a garment having multiple layers secured to one another by a fastener.

BACKGROUND OF THE INVENTION

Garments having detachable portions are well known in the industry. For example, jackets having arms and/or liners attached by way of zippers are well known. Having a garment with a detachable portion enables a wearer to add or shed the portion depending on the ambient temperature and/or their physical activity level, thereby optimizing their comfort level.

When individuals are engaged in a physical activity, e.g., an athletic activity such as running, playing tennis, soccer, or another sport, their comfort level at a given ambient temperature can vary greatly depending on their physical activity level. When an individual begins an athletic activity, they will typically need much warmer clothing than that needed during strenuous physical activity. Accordingly, the individual may wish to dress warmly when starting the activity, but desire to shed some clothing as their activity level progresses, and also when the ambient temperature increases. Conversely, when the ambient temperature decreases or the individual's activity level decreases, the individual may wish to add layers to provide warmth. Further, differing weather conditions may dictate the need for layers having particular characteristics, e.g., water resistance. Accordingly, an individual typically will attempt to dress in layers to provide for these different situations and conditions.

Additionally, individuals involved in athletic competitions, such as running races, triathlons, etc., may have a need to add and shed layers very quickly. Many such races are won or lost by mere seconds, and the ability to change clothing layers quickly could make the difference between winning and losing a race. Thus, it would be desirable to have a garment system having layers secured to one another by fasteners that can be quickly and easily secured and released, and are not susceptible to breakage or other non-functional results.

U.S. Pat. No. 4,554,682 to Hillquist discloses a convertible jacket having a sleeveless vest and an upper component formed of two sleeve portions connected by a yoke portion. The upper component is secured to the vest by a pair of buttons. Hillquist is limiting in that the garment includes only a single sleeveless vest and a single upper component. Hillquist, therefore, provides a wearer with a limited ability to adapt to different weather conditions. Further, the buttons of Hillquist are not easily attached or detached when a user is engaged in an athletic activity, e.g., running, and such fasteners can easily be destroyed during athletic activities. Other fasteners, e.g., zippers, are also not easily or quickly fastened, and can become jammed. Additionally, often times a user will need to look at the buttons and/or zippers in order to secure them, which can prevent a user from switching quickly from one garment combination to another.

Thus, known garments do not provide a user the ability to adapt to various weather conditions and levels of physical activity. Further, such known garments are not suitable for athletic activities where the user seeks to quickly change from one combination of garments to another, and needs to have the garments securely fastened to one another to stand up to the rigors of the athletic activity being engaged in by the user.

It is an object of the present invention to provide a garment that reduces or wholly overcomes some or all of the difficulties inherent in prior known devices. Preferred embodiments of the present invention can provide a garment having multiple layers that can be combined to adapt to various conditions and are secured to one another with fasteners. Other embodiments provide garments with layers secured by way of fasteners that can be quickly and easily fastened together, as well as easily separated so that a layer may be shed. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the present invention may be used advantageously to provide a garment having multiple layers secured to one another with fasteners that allow a user to easily adapt to various weather conditions or levels of physical activity, or provide other desired characteristics. Thus, users can easily add and shed layers while securely fastening the layers to one another.

In accordance with a first aspect, a garment system includes a plurality of torso covering members, with each torso covering member having a configuration that is different than a configuration each of the other torso covering members. A plurality of upper back and shoulder covering members are provided, with each upper back and shoulder covering member having a configuration that is different than a configuration of each of the other upper back and shoulder covering members. The garment system also includes a plurality of fasteners, with each fastener having a first portion secured to one of the torso covering members and a second portion secured to one of the upper back and shoulder covering members. Each one of the upper back and shoulder covering members can be secured to any one of the torso covering members by securing the second portion of the fastener of the each one of the upper back and shoulder covering member to the first portion of the fastener of a corresponding torso covering member.

In accordance with a second aspect, a garment includes a torso covering member and an upper back and shoulder covering member secured to the torso covering member by a magnetic fastener.

In accordance with a further aspect, a garment system includes a torso covering member and an upper back and shoulder covering member. A first portion of a magnetic fastener is secured to the torso covering member. A second portion of the magnetic fastener is secured to the upper back and shoulder covering member. At least one of the first and second portions has a surface discontinuity configured to mate with other of the first and second portions of the magnetic fastener, the first and second portions cooperating to secure the upper back and shoulder covering member to the torso covering member.

Substantial advantage is achieved by providing a garment having multiple layers secured to one another in different combinations by fasteners. In particular, preferred embodiments of the present invention provide a user with they ability to easily adapt to different weather conditions and levels of physical activity. Certain embodiments of the present invention allow layers of garments to be secured to one another quickly and easily by magnetic fasteners. This is highly advantageous since a wearer can add or shed layers of clothing quickly while minimizing the need to look at the fasteners and layers of the garment in order to secure the fasteners.

These and additional features and advantages of the invention disclosed here will be further understood from the following detailed disclosure of certain preferred embodiments.

Figure 1:
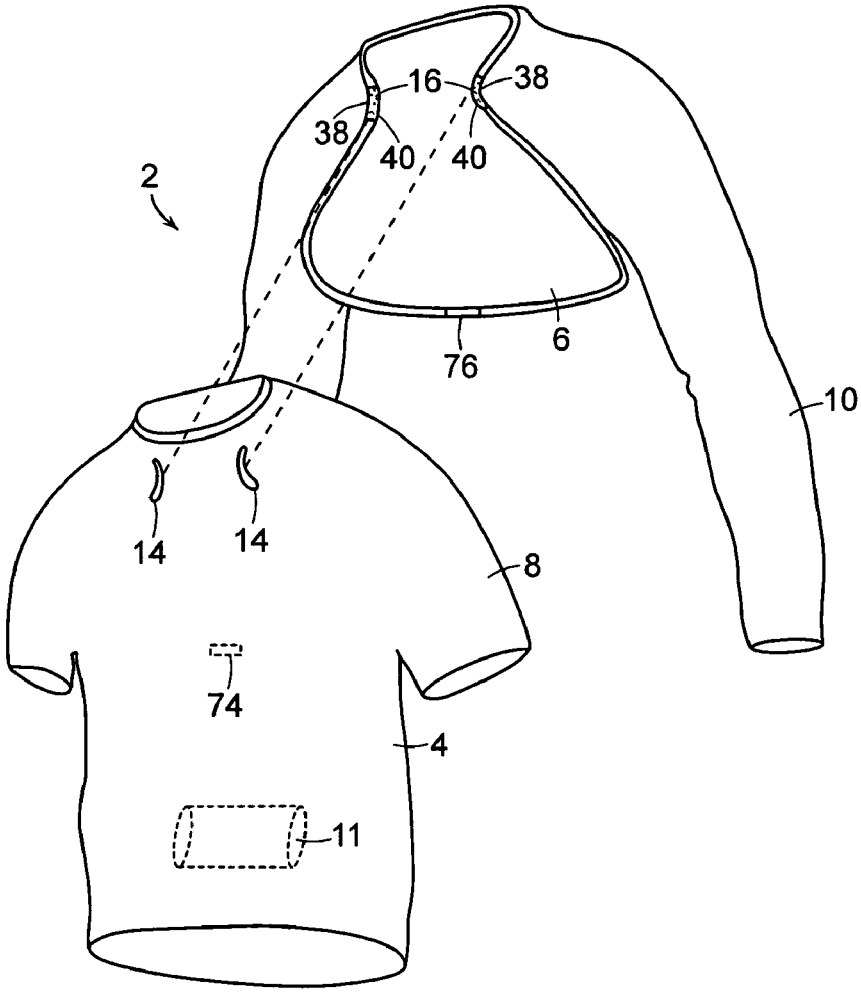
FIG. 1 is a perspective view in exploded form of a garment in accordance with a preferred embodiment of the present invention.

The figures referred to above are not drawn necessarily to scale and should be understood to present a representation of the invention, illustrative of the principles involved. Some features of the garment with multiple layers depicted in the drawings have been enlarged or distorted relative to others to facilitate explanation and understanding. The same reference numbers are used in the drawings for similar or identical components and features shown in various alternative embodiments. Garments with a multiple layers as disclosed herein, will have configurations and components determined, in part, by the intended application and environment in which they are used.

DETAILED DESCRIPTION OF CERTAIN PREFERRED EMBODIMENTS

As described in greater detail below, the present invention is directed to a garment including a torso covering member and an upper back and shoulder covering member. In certain preferred embodiments, a garment system includes a plurality of torso covering members and upper back and shoulder covering members. The members may have different configurations, allowing different combinations of these elements to provide garments having, for example, a variety of aesthetic designs, different weather protecting characteristics and various levels of thermal protection. Thus, a user can have a single garment system capable of adapting to a variety of conditions or producing a variety of desired looks.

A preferred embodiment of a garment 2 in accordance with the present invention is shown in FIG. 1. Garment 2 may include a torso covering member 4 and an upper back and shoulder covering member 6. In the illustrated embodiment, torso covering member 4 includes sleeves 8, shown here as short sleeves. In the illustrated embodiment, upper back and shoulder covering member 6 includes sleeves 10, shown here as long sleeves. It is to be appreciated that each of torso covering member 4 and upper back and shoulder covering member 6 could have short sleeves, long sleeves, or no sleeves at all.

Torso covering member 4 is worn by an individual as a shirt, substantially covering their torso and, in the embodiment illustrated with short sleeves, the shoulders and upper arms of the individual. Upper back and shoulder covering member 6 is configured to be worn on top of, and to be secured to, torso covering member 4, as described in greater detail below. Upper back and shoulder covering member 6 provides a second layer of material for at least the upper back and shoulders of an individual, and, in embodiments including sleeves, for at least a portion of the arms of the individual as well.

In a preferred embodiment, torso covering member 4 has a pocket 11 that is configured to receive upper back and shoulder covering member 6 to provide for storage of upper back and shoulder covering member 6 when not in use. In the illustrated embodiment, pocket 11 is positioned on the back of torso covering member 4. It is to be appreciated that pocket 11 can be located elsewhere on torso covering member 4, e.g., on the front.

Fasteners are used to secure upper back and shoulder covering member 6 to torso covering member 4. In certain preferred embodiments, a pair of fasteners is used to secure each upper back and shoulder covering member 6 to torso covering member 4. In other preferred embodiments, additional fasteners may be used to secure the members of garment 2 together, and the particular number of fasteners used is not critical.

In a preferred embodiment, magnetic fasteners are used to secure upper back and shoulder covering member 6 to torso covering member 4 The use of magnetic fasteners allows a user to easily and quickly secure upper back and shoulder covering member 6 to torso covering member 4. This can be especially advantageous in situations where time is of the essence for the user, such as when engaged in a race or other athletic event. It is to be appreciated that other types fasteners may be used to secure upper back and shoulder covering member 6 to torso covering member 4 including, for example, hook and loop type fasteners.

Figure 2:
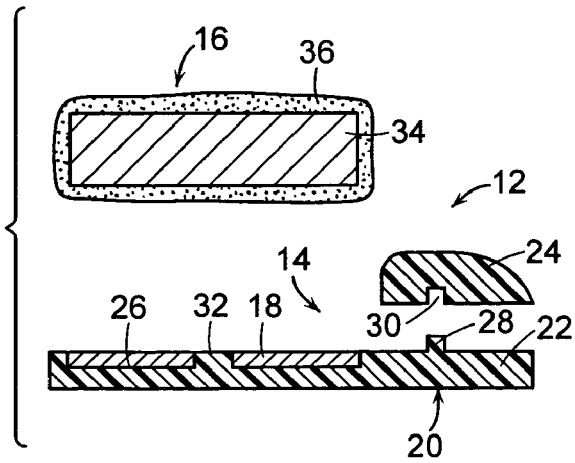
FIG. 2 is a section view in exploded form of a preferred embodiment of the fastener of the garment of FIG. 1, showing first and second portions of a magnetic fastener.

As seen in FIG. 2, a fastener 12 may be formed of a first portion 14 and a second portion 16. First portion 14 is secured to torso covering member 4 while second portion 16 is secured to upper back and shoulder covering member 6, as described below. It is to be appreciated that in other preferred embodiments, first portion 14 may be secured to upper back and shoulder covering member 6 and second portion 16 may be secured to torso covering member 4.

In certain preferred embodiments, both first portion 14 and second portion 16 include magnetic elements. In some embodiments, one of the magnetic elements is a magnet and the other is a piece of metal, e.g., steel. In other embodiments, both magnetic elements are magnets.

In the embodiment illustrated in FIG. 2, first portion 14 is formed of a magnetic element 18 and a carrier 20. Magnetic element 18 may be a magnet or, as illustrated in FIG. 1, a piece of metal. Carrier 20 may be formed of a first segment 22 and a second segment 24. In the illustrated embodiment, first segment 22 has a recess 26 within which magnetic element 18 is received. First segment 22 has a projection 28 extending outwardly from a surface thereof. Second segment 24 has a recess 30 configured to receive projection 28 when second segment 24 is assembled, as described in greater detail below.

Carrier 20 may be formed of plastic, e.g., nylon. First segment 22 may be molded around magnetic element 18, in which case, magnetic element 18 may have apertures 32 into which the material of which first segment 22 is formed flows during the molding process, thereby firmly securing magnetic element 18 to first segment 22 of carrier 20.

In a preferred embodiment, as seen in FIG. 2, second portion 16 comprises a magnetic element 34 and a coating 36. In the illustrated embodiment, magnetic element 34 is a magnet. Coating 36 may be a heat sensitive adhesive that is non-tacky at ambient temperature. Coating 36 may be formed of, for example, thermoplastic urethane. Upon the application of heat, coating 36 becomes tacky, allowing first portion 16 to adhere to the fabric of upper back and shoulder covering member 6, as described in greater detail below.

Figure 3:
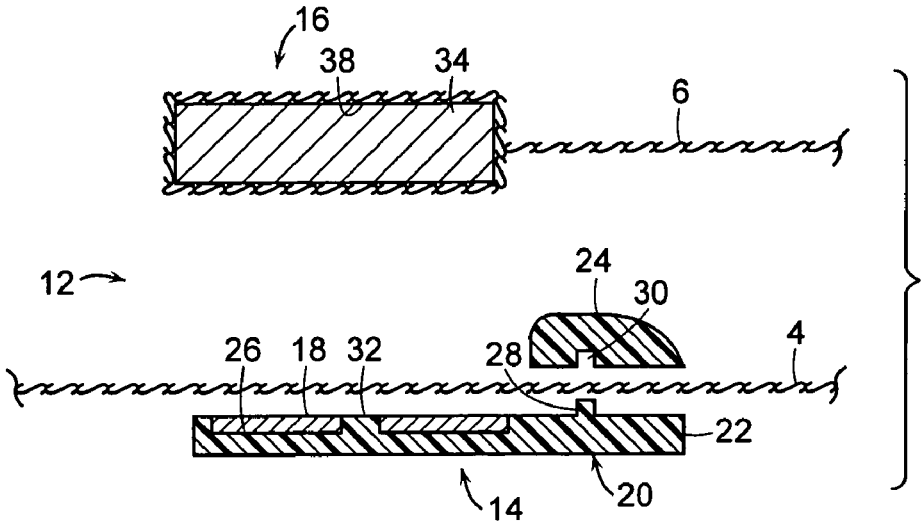
FIG. 3 is section view of the magnetic fastener of FIG. 2, showing first and second portions of the magnetic fastener being secured to the torso covering member and the upper back and shoulder covering member, respectively, of FIG. 1.
Figure 4:
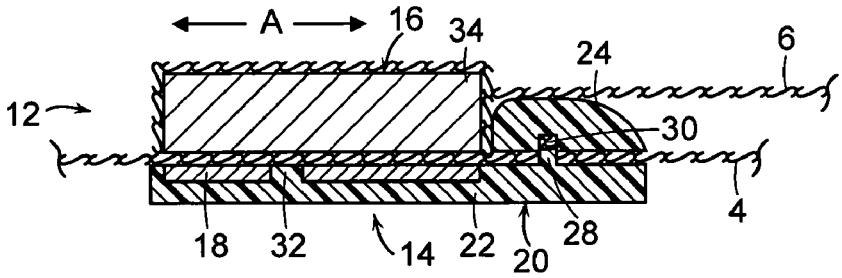
FIG. 4 is a section view of the magnetic fastener of FIG. 2, showing the first and second portions of the magnetic fastener secured to the torso covering member and the upper back and shoulder covering member, respectively, of FIG. 1.

To secure first portion 14 to torso covering member 4, first segment 22 is positioned on one side of torso covering member 4 and second segment 24 is positioned on the opposite side of torso covering member 4, as seen in FIG. 3. First and second segments 22, 24 are then pressed together such that projection 28 engages recess 30 in an interference fit, thereby sandwiching the material of torso covering member 4 between them, as seen in FIG. 4. First and second segments 22, 24 are typically pressed together using a kick press (not shown). Kick presses are well known to those skilled in the art for securing such fasteners, and further description of their use is not needed here.

To secure second portion 16 to upper back and shoulder covering member 6, second portion 16 is first slipped into a pocket 38 formed on upper back and shoulder covering member 6. In a preferred embodiment, pocket 38 is formed along an edge of upper back and shoulder covering member 6 as seen in FIG. 3. In the embodiment shown in FIG. 1, pockets 38 are formed along arcuate edges 40 of upper back and shoulder covering member 6, which are proximate the neck of an individual wearing garment 2. Pocket 38 may be formed by piping sewn along the edge of upper back and shoulder covering member 6, or by folding over a portion of upper back and shoulder covering member 6 and then sewing or otherwise securing the folded over portion to the remaining material. Other methods of forming a suitable pocket 38 for receiving second portion 16 will become readily apparent to those skilled in the art, given the benefit of this disclosure.

Once second portion 16 has been positioned within pocket 38, heat can then be applied to pocket 38, thereby causing coating 36 to become tacky and at least partially seep into the surface of pocket 38. Once coating 36 cools, second portion 16 is securely fastened to upper back and shoulder covering member 6 within pocket 38.

In use, magnetic fasteners 12 secure upper back and shoulder covering member 6 to torso covering member 4. When an individual wears garment 2, torso covering member 4 is put on first. The individual then places upper back and shoulder covering member 6 on, securing it to torso covering member 4 with first and second portions 14, 16 of magnetic fastener 12. First and second portions 14, 16 are self-locating due to their magnetic attraction, making the act of securing upper back and shoulder covering member 6 to torso covering member 4 very easy for the wearer. This is especially advantageous when the user is involved in an athletic activity in which time is critical. Thus, for example, when an individual is running in a race wearing only torso covering member 4 and desires to add a layer, donning upper back and shoulder covering member 6 can be quickly and easily accomplished. The individual puts their arms into upper back and shoulder covering member 6 and pulls it over their shoulders. Due to magnetic attraction, the user merely needs to get second portion 16 close to first portion 14, and the two portions of magnetic fastener 12 self-locate, thereby securing the pieces of garment 2 together. This can be accomplished as individual continues to run, without the need to stop to add the extra layer. Fastening the two layers of garment 2 together is, therefore, quite simple, and much easier and faster to accomplish than it would be with a garment having buttons, zippers or snaps, which might require the wearer to visually look at the collar area of the garment as they fasten the two layers together.

In a preferred embodiment, one or both of first portion 14 and second portion 16 has a surface discontinuity configured to mate with the other of first portion 14 and second portion 16 such that when they are secured to one another they resist lateral forces, thereby more securely fastening upper back and shoulder covering member 6 to torso covering member 4. In the embodiment illustrated in FIGS. 2–4, first portion 14 has a surface discontinuity consisting of second segment 24. When upper back and shoulder covering member 6 is secured to torso covering member 4, a side of second segment 24 abuts and mates with a side of first portion 16, thereby providing resistance to lateral forces in the direction of arrows A. This helps to prevent upper back and shoulder covering member 6 from inadvertently being removed from torso covering member 4.

It is to be appreciated that the surface discontinuity of magnetic fastener 12 may be formed as part of first portion 14, as illustrated, or as part of second portion 16, or as part of both first portion 14 and second portion 16. Further, the surface discontinuity could be part of a carrier for a magnetic element of one of the portions, or be part of the magnetic element itself. Other configurations for suitable surface discontinuities will become readily apparent to those skilled in the art, given the benefit of this disclosure.

Figure 5:
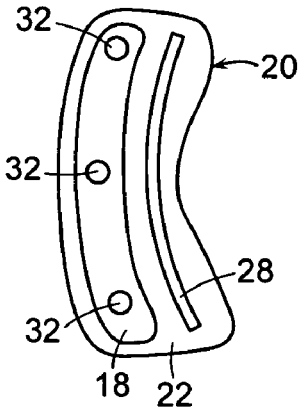
FIG. 5 is a plan view of the first segment of the first portion of the magnetic fastener of FIG. 2.
Figure 6:
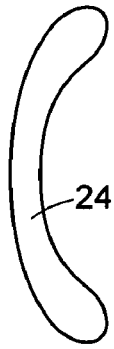
FIG. 6 is a plan view of the second segment of the first portion of the magnetic fastener of FIG. 2.
Figure 7:
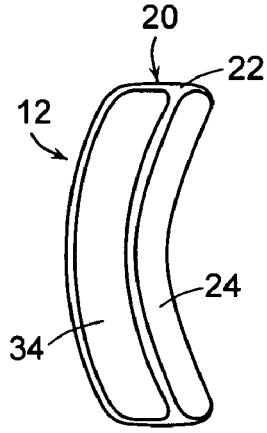
FIG. 7 is a plan view of the first portion of the magnetic fastener of FIG. 2 in its assembled condition.

In certain preferred embodiments, as seen in FIG. 5, magnetic element 18 has an arcuate shape. Projection 28 similarly extends along an arcuate path, substantially parallel to the arcuate edge of magnetic element 18. As seen in FIG. 6, second segment 24 also has a substantially arcuate shape. As seen in FIG. 7, where magnetic element 34 is shown directly secured to magnetic element 18 for the purposes of illustration, magnetic element 34 similarly has an arcuate shape such that an arcuate edge of second segment 24 will nest with an arcuate edge of magnetic element 34, thereby providing additional resistance to lateral forces exerted on magnetic fastener 12. It is to be appreciated that first and second portions 14, 16 may have other shapes that will help them nest together and resist lateral forces.

Figure 8:
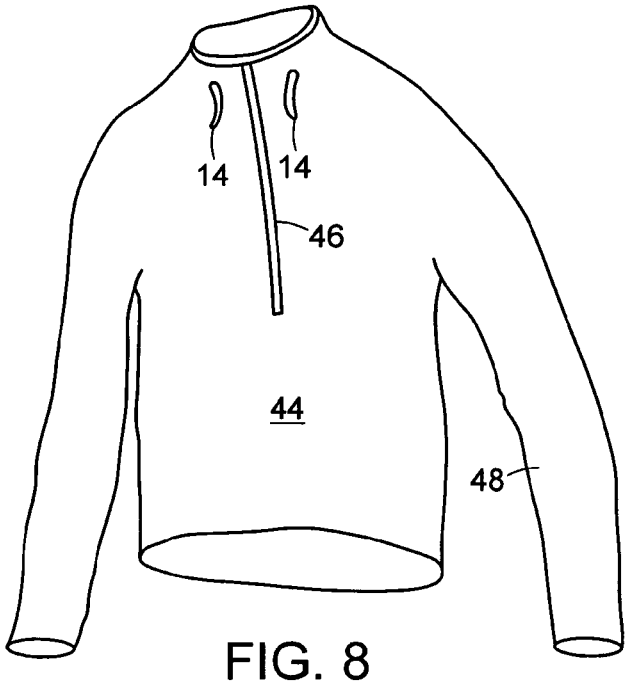
FIG. 8 is a perspective view of an alternative embodiment of the torso covering member of FIG. 1.
Figure 9:
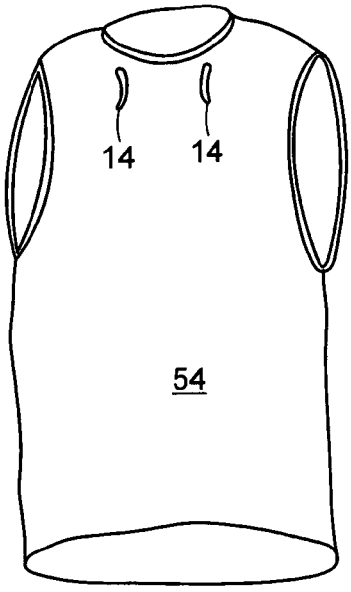
FIG. 9 is a perspective view of another alternative embodiment of the torso covering member of FIG. 1.
Figure 10:
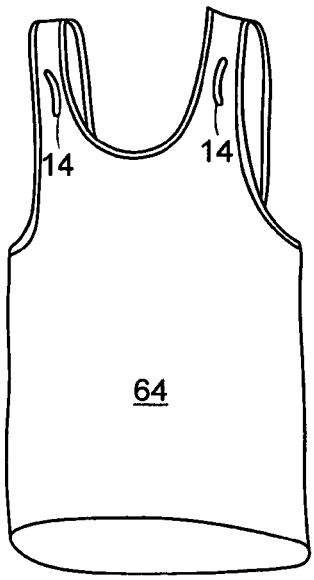
FIG. 10 is a perspective view of yet another alternative embodiment of the torso covering member of FIG. 1.
Figure 11:
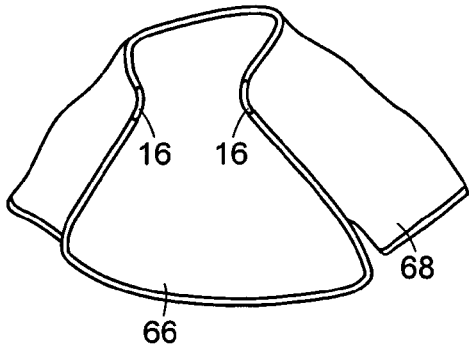
FIG. 11 is a perspective view of an alternative embodiment of the upper back and shoulder covering member of FIG. 1.

In the embodiment illustrated in FIG. 1, torso covering member 4 is shown as a jersey with short sleeves. It is to be appreciated that torso covering member 4 may have alternative configurations. For example, as seen in FIG. 8, a torso covering member 44 may have a zipper 46, which may be a partial zipper or a full zipper (not shown). Further, torso covering member 44 may have long sleeves 48. Alternatively, a torso covering member 54 could be sleeveless as seen in FIG. 9. As seen in FIG. 10, a torso covering member 64 may be a tank top. Thus, it is to be appreciated that torso covering member 4 may have any of various shapes, including, but not limited to, those listed above. Similarly, as seen in FIG. 11, an upper back and shoulder covering member 66 may have short sleeves 68 rather than the long sleeves illustrated in FIG. 1.

In certain preferred embodiments, additional fasteners may be used to help secure upper back and shoulder covering member 6 to torso covering member 4. As seen in FIG. 1, an additional first portion 74 may be secured to a back of torso covering member 4, and a mating second portion 76 may be secured to a lower edge on the back of upper back and shoulder covering member 6. In the illustrated embodiment, first portion 74 and second portion 76 have a straight shape rather than an arcuate shape. It is to be appreciated that more than one additional fastener may be used, and that first portion 74 and second portion 76 may have a shape other than straight, including, but not limited to, an arcuate shape. First portion 74 and second portion may have configurations similar to first portion 14 and second portion 16 described above.

Figure 12:
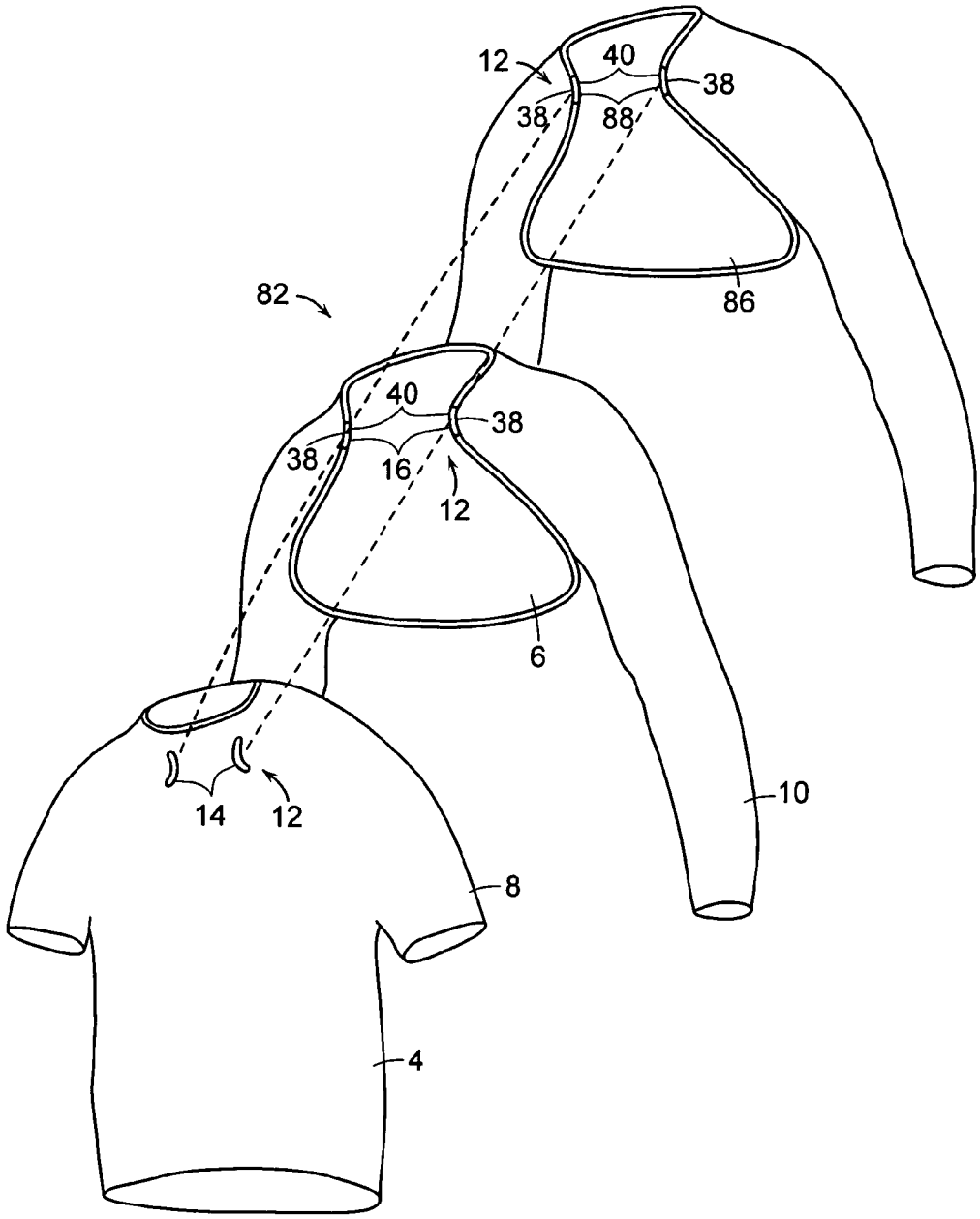
FIG. 12 is a perspective view in exploded form of an alternative embodiment of the torso covering member of FIG. 1, shown with a second upper back and shoulder covering member.

In certain preferred embodiments, as seen in FIG. 12, a garment 82 includes a second upper back and shoulder covering member 86. Second upper back and shoulder covering member 86 includes a third portion 88 of fastener 12, which adheres to second portion 16. Thus, garment 82 comprises a torso covering member 4, a first upper back and shoulder covering member 6, and a second upper back and shoulder covering member 86, each secured to the others by respective portions of fastener 12.

In another embodiment, a plurality of torso covering members 4 is provided, each of which has a different configuration than the other torso covering members 4. The configurations of the torso covering members might, for example, be aesthetic designs, weather protecting characteristics or other physical characteristics. For instance, one torso covering member 4 might be a base layer, having a weather protecting characteristic designed to wick away moisture. Another torso covering member 4 might be a thermal layer, designed to provide warmth. Yet another torso covering member 4 might be water resistant or waterproof. Thus, it can be seen that the wearer can select a torso covering member most appropriate to the conditions they will face while wearing the garment, most desirable from an aesthetic point of view, or most advantageous with respect to another physical characteristic of the torso covering member.

Similarly, a plurality of upper back and shoulder covering members 6 is provided, each of which has a different configuration than the other upper back and shoulder covering members 6. The configurations of the upper back and shoulder covering members can vary as do the torso covering members 4. In certain embodiments, each upper back and shoulder covering member 6 has a configuration that is the same as the configuration of a respective torso covering member.

Similarly, a plurality of second upper back and shoulder covering members 86 can be provided, each with a different configuration, allowing a user to mix and match three components to produce a garment having any desired combination of aesthetic, weather protecting, or other characteristics.

Consequently, a user can combine a torso covering member having a particular configuration with one or more upper back and shoulder covering members having particular configurations, which may be the same as or different than each other and that of the torso covering member. In one example, a wearer could don a torso covering member that is a thermal layer and an upper back and shoulder covering member that is waterproof or water resistant. In another example, the wearer might use a torso covering member that is designed to wick away moisture, a first upper back and shoulder covering member that is a thermal layer, and a second upper back and shoulder covering member that is wind resistant. Thus, it can be seen that this embodiment, in which a plurality of torso covering members and upper back and shoulder covering members are provided, is particularly advantageous, since it allows a user to quickly and easily adapt to varying weather conditions and varying levels of physical activity.

It will be readily apparent to those skilled in the art, given the benefit of this disclosure, that numerous combinations for the members of a garment are possible and that the embodiments described herein are merely examples of the many possible combinations.

It is to be appreciated that the configurations of torso covering members and upper back and shoulder covering members can vary based on any physical characteristic including, for example, UV protection, wind protection, thermal insulation, high visibility for safety, and body moisture management. Accordingly, the material of which the torso covering member and upper back and shoulder covering member is formed is entirely dependent on the desired characteristics of that member.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A garment system comprising, in combination:

a plurality of torso covering members, each torso covering member having a configuration that is different than a configuration each of the other torso covering members;

a separate plurality of upper back and shoulder covering members, each upper back and shoulder covering member having a configuration that is different than a configuration of each of the other upper back and shoulder covering members; and a plurality of fasteners, each fastener comprising a first portion secured to one of the torso covering members and a second portion secured to one of the upper back and shoulder covering members;

wherein each one of the upper back and shoulder covering members can be secured to any one of the torso covering members by securing the second portion of the fastener of the each one of the upper back and shoulder covering member to the first portion of the fastener of a corresponding torso covering member.

2. The garment system of claim 1, wherein each upper back and shoulder covering member has a weather protecting characteristic that is different than a weather protecting characteristic of each of the other upper back and shoulder covering members.

3. The garment system of claim 1, wherein each torso covering member has a weather protecting characteristic that is different than a weather protecting characteristic of each of the other torso covering members.

4. The garment system of claim 1, wherein the fasteners are magnetic fasteners.

5. The garment system of claim 4, wherein at least one of the first portion and the second portion of each magnetic fastener has a surface discontinuity configured to mate with the other of the first portion and second portion.

6. The garment of claim 1, wherein one of the first portion and the second portion includes a magnet.

7. The garment of claim 6, wherein the other of the first portion and the second portion includes a magnet.

8. The garment of claim 6, wherein the other of the first portion and the second portion includes a piece of metal.

9. The garment of claim 1, wherein the first portion comprises a magnetic element having a coating thereon.

10. The garment of claim 9, wherein the coating is a heat sensitive adhesive.

11. The garment of claim 9, wherein the magnetic element is one of a magnet and a piece of metal.

12. The garment of claim 1, wherein each torso covering member is one of a vest and a tank top.

13. The garment of claim 1, wherein each torso covering member has one of short and long sleeves.

14. The garment of claim 1, wherein each upper back and shoulder covering portion has one of long sleeves and short sleeves.

15. The garment of claim 1, wherein a front of each upper back and shoulder covering member is secured to a front of a corresponding torso covering member.

16. The garment system of claim 1, wherein each upper back and shoulder covering member has a weather protecting characteristic that is the same as a weather protecting characteristic of one of the torso covering members.

17. The garment system of claim 1, wherein each torso covering member includes a pocket configured to receive a corresponding upper back and shoulder covering member.

18. The garment system of claim 1, wherein each torso covering member and each upper back and shoulder covering member has a desired aesthetic characteristic.

19. The garment system of claim 1, wherein each torso covering member and each upper back and shoulder covering member has a desired physical characteristic.

20. A garment system comprising, in combination:

a torso covering member;

an upper back and shoulder covering member;

a first portion of a magnetic fastener secured to the torso covering member;

a second portion of the magnetic fastener secured to the upper back and shoulder covering member; and a second upper back and shoulder covering member secured to the upper back and shoulder covering member by a third portion of the magnetic fastener secured to the upper back and shoulder covering member;

wherein at least one of the first and second portions has a surface discontinuity configured to mate with other of the first and second portions of the magnetic fastener, the first and second portions cooperating to secure the upper back and shoulder covering member to the torso covering member.

21. The garment system of claim 20, wherein the torso covering member includes a pocket configured to receive the upper back and shoulder covering member.

22. The garment system of claim 20, wherein one of the first portion and the second portion is a magnet.

23. The garment system of claim 22, wherein the other of the first portion and the second portion is a magnet.

24. The garment system of claim 22, wherein the other of the first portion and the second portion is a piece of metal.

25. The garment system of claim 20, wherein the first portion is positioned on a front of the torso covering member.

26. The garment system of claim 20, wherein the second portion is positioned on a front of the upper back and shoulder covering member.

27. The garment system of claim 20, wherein the first and second portions have an arcuate shape.

28. The garment system of claim 20, wherein the upper back and shoulder covering member includes one of long sleeves and short sleeves.

29. The garment system of claim 20, wherein the torso covering member is one of a vest and a tank top.

30. The garment system of claim 20, wherein the torso covering member has one of short and long sleeves.

31. The garment system of claim 1, wherein at least one torso covering member includes a pocket configured to receive a corresponding upper back and shoulder covering member.

32. The garment system of claim 1, wherein at least one torso covering member is configured to wick away moisture.

33. The garment system of claim 1, wherein at least one torso covering member is a thermal layer.

34. The garment system of claim 1, wherein at least one torso covering member is water resistant.

35. The garment system of claim 1, wherein at least one torso covering member is a waterproof.

36. The garment system of claim 1, wherein at least one torso covering member is configured to provide UV protection.

37. The garment system of claim 1, wherein at least one torso covering member is wind resistant.

38. The garment system of claim 1, wherein at least one upper back and shoulder covering member is configured to wick away moisture.

39. The garment system of claim 1, wherein at least one upper back and shoulder covering member is a thermal layer.

40. The garment system of claim 1, wherein at least one upper back and shoulder covering member is water resistant.

41. The garment system of claim 1, wherein at least one upper back and shoulder covering member is a waterproof.

42. The garment system of claim 1, wherein at least one upper back and shoulder covering member is configured to provide UV protection.

43. The garment system of claim 1, wherein at least one upper back and shoulder covering member is wind resistant.

* * * * *